US007423538B2

(12) United States Patent
Gonzalez

(10) Patent No.: US 7,423,538 B2
(45) Date of Patent: Sep. 9, 2008

(54) CHILD ALERT SYSTEM

(76) Inventor: Thomas A. Gonzalez, 6138 Maclay St., San Bernardino, CA (US) 92407

( * ) Notice: Subject to any disclaimer, the term of this patent is extended or adjusted under 35 U.S.C. 154(b) by 267 days.

(21) Appl. No.: 11/452,548

(22) Filed: Jun. 15, 2006

(65) Prior Publication Data

US 2006/0232429 A1 Oct. 19, 2006

Related U.S. Application Data

(63) Continuation-in-part of application No. 11/187,198, filed on Jul. 21, 2005, now Pat. No. 7,084,771, and a continuation-in-part of application No. 09/784,654, filed on Feb. 15, 2001, now Pat. No. 6,963,283.

(51) Int. Cl.
*G08B 23/00* (2006.01)

(52) U.S. Cl. ..... 340/573.1; 340/573.4; 340/539.1; 340/574; 340/693.2; 340/568.2; 342/457; 342/357.06; 701/213

(58) Field of Classification Search ..... 340/573.1, 340/573.4, 539.1, 574, 693.2, 568.2; 342/457, 342/357.06; 701/213
See application file for complete search history.

(56) References Cited

U.S. PATENT DOCUMENTS

| | | | | |
|---|---|---|---|---|
| 4,876,710 | A | 10/1989 | Reed et al. | |
| 5,661,460 | A * | 8/1997 | Sallen et al. | 340/573.4 |
| 5,982,808 | A | 11/1999 | Otto | |
| 6,198,390 | B1 * | 3/2001 | Schlager et al. | 340/540 |

* cited by examiner

*Primary Examiner*—Tai T Nguyen
(74) *Attorney, Agent, or Firm*—Kirk A. Buhler; Buhler & Assocaites

(57) ABSTRACT

A child alert system that uses radio transmitters and receivers to provide the location of a child, adult or object to which a transmitter unit of the system is attached. The transmitter unit includes a panic button for allowing the wearer of the transmitter unit to send a panic signal when they feel endangered. The system further includes signaling when the transmitter is submerged, when the vital signs of the wearer fall below a certain threshold, or when the transmitter is tampered or removed from the person.

5 Claims, 3 Drawing Sheets

CHILD ALERT SYSTEM

CROSS REFERENCE TO RELATED APPLICATION

This application is a continuation-in-part of applicant's application Ser. No. 09/784,654 filed Feb. 15, 2001 now U.S. 6,963,283 and applicant's continuation-in-part application Ser. No. 11/187,198 filed Jul. 21, 2005 now U.S. Pat. No. 7,084,771.

FIELD OF THE INVENTION

The present invention is that of an electronic transmitting device that would allow authorities to locate a missing child or adult. More specifically the invention relates to a transmitter that is worn by a user and a receiver that can triangulate on the signal from the transmitter to provide a location where the transmitter is located.

BACKGROUND OF THE INVENTION

The present invention would be an electronic transmitting device that would be remotely activated by authorities to locate a missing child or adult, or instead could be activated by the wearer to send out an emergency signal when in danger by using satellite triangulation. The system further includes signaling when the transmitter is submerged, when the vital signs of the wearer fall below a certain threshold, or when the transmitter is tampered or removed from the person.

BRIEF SUMMARY OF THE INVENTION

The present invention would comprise a receiver unit and a transmitter unit.

The transmitter unit of the present invention would feature a small battery powered transmitter that would be worn as a watch, bracelet, or pinned to the clothing of a child and would be activated either remotely or by a user, to allow their location to be quickly determined. The transmitter would have a panic button allowing a wearer to send out an emergency signal if they so desired. The panic button would have to be pushed twice, which would prevent accidental activation, in order to send out a signal that would be picked up by the receiver unit of the present invention to alert the receiver unit that the wearer of the transmitter unit requires aid or assistance.

Local authorities or parents would maintain the receiver unit of the present invention, and would have the frequency or frequencies of all transmitters in the local area loaded into the receiver unit's software. By doing this, this would alert the authorities to activate the applicable user-worn transmitter in the event that a specific person is reported missing. It would also allow the authorities to identify the user when the wearer of the device sends out an emergency signal.

The present invention could also have a receiver that would be as small as the size of a pager. The pager would have an adjustable range setting, which would be set off if the child, person, or other object that would be carrying the transmitter would be further away in distance than the preset distance on the receiver. A parent or guardian would carry the receiver, in this instance. The receiver could also be powered by an automobile for tracking.

Use of the present invention would provide a method of quickly locating a lost, injured, or abducted child or adult, and would also allow that person to send out an emergency signal if they were in danger, so that authorities could quickly come to their aid. The present invention could also be utilized with a pet.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION

Figure 1:
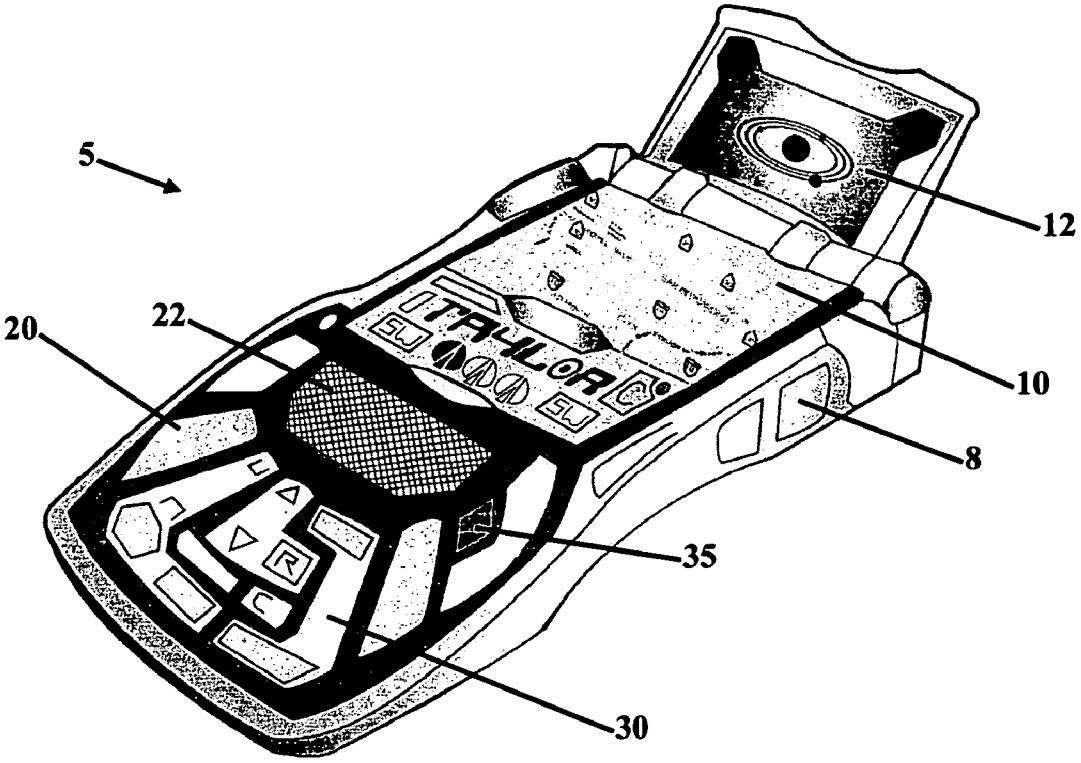
FIG. 1 is a perspective view of an exemplary embodiment of the receiver unit.

FIG. 1 shows a receiver view of an exemplary embodiment of the receiver unit. The reciver base unit 5 consists of an enclosure adapted or designed to locate and display the loction of one or more transmitters that are activated or the location is requested. The receiver consists of a display 10 that shows the Geo location of the transmitter. The Geo location may be in units of longitude and latitude with sufficeient detail to pin point the location of the transmitter. The display 10 may alternatively provide distance and direction information. The distance and direction information may point the direction from the receiver with an arrow pointing to where they are located, and a distance in feet, yards, miles, meters, kilometers or other indicators along with a North, South, East, West or degrees information. A flip-up cover 15 protects the display from damage. A set of pre-porgrammed range/distance setting buttons 20 can allow the operator to set the range and or distance that the transmitter can be removed from the receiver before a message or alert is signalled. The setting, selection and or programming buttons 30 allow information to the entered into the receiver for identification of each specific transmitter the receiver can track. A USB or similar communications port 8 may be included to provide communication or programming of the unit from a computer or other source. A speaker/microphone 22 can also be included to provide audible feedback or communication. A reset button 35 allows the receiver to be reset for entering information for another transmitter. The receiver display 10 may further include time tracking information that can identify how long the signal has been active. It is also contemplated that the display can identify other status information regarding the person wearing the transmitter such as vital signs, if the transmitter has been submerged in water, or if the transmitter is being tampered with or removed.

Figure 2:
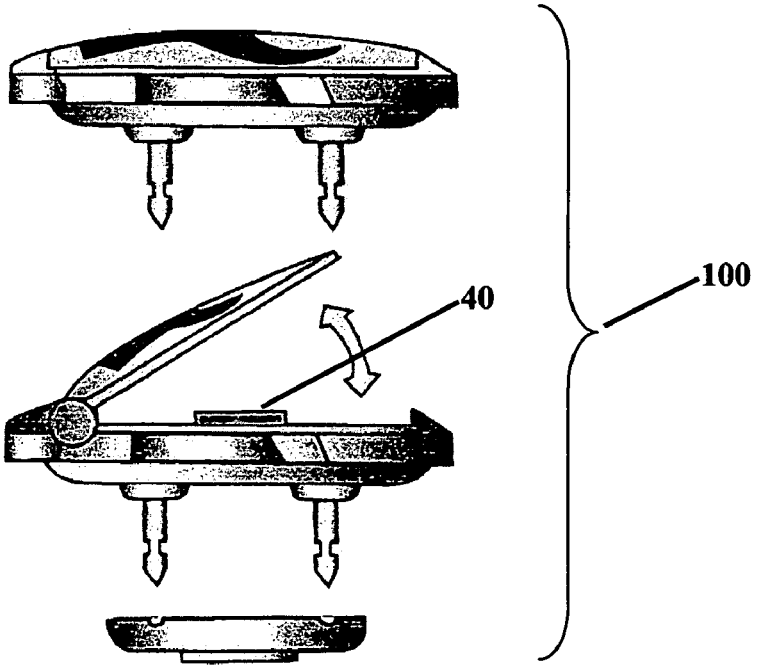
FIG. 2 is a side plan view of a round pin style transmitter.

FIG. 2 shows a side plan view of a round pin style transmitter unit 100 that can be warn on a lapel or similar area like a piece of jewelry. This figure shows the transmitter in a simplified form with a panic button 40 located in the center of the round pin style transmitter under a protective lid. It is contemplated that this version of transmitter can be fabricated in a stylish, modern, classical or ornate design as well as an insignia style. It is also contemplated that students from a school class on a field trip could each be issued a transmitter identifying the students as being from a single school as well as allowing them to both signal in the event of an emergency and to be located.

Figure 3:
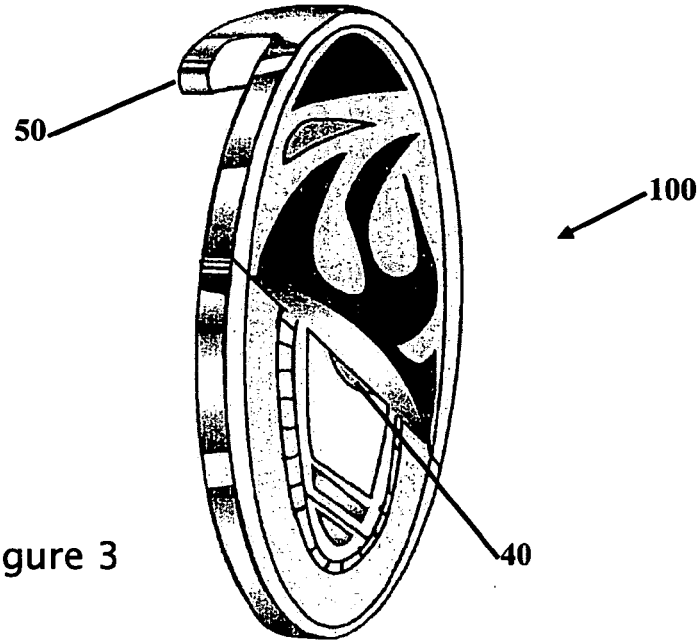
FIG. 3 is an isometric view of a clip style transmitter.

FIG. 3 shows an isometric view of a clip style transmitter 100. In this embodiment, the transmitter is configured with a clip 50 that can be placed over the lip of a pocket or on a pants loop. This type of configuration is ideal for applications where attachment through a garment is difficult. The panic button 40 can easily be reached and pressed if the person is in trouble or needs assistance. It is contemplated that this version of transmitter can be fabricated in a stylish, modern, classical or ornate design as well as an insignia style.

Figure 4:
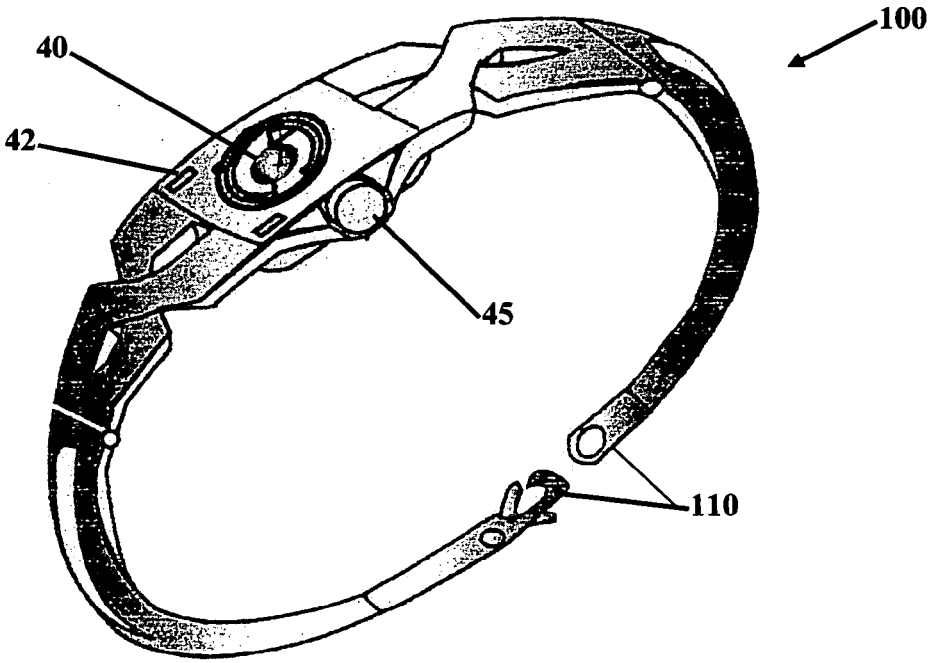
FIG. 4 is a isometric view of a bracelet style transmitter.
Figure 5:
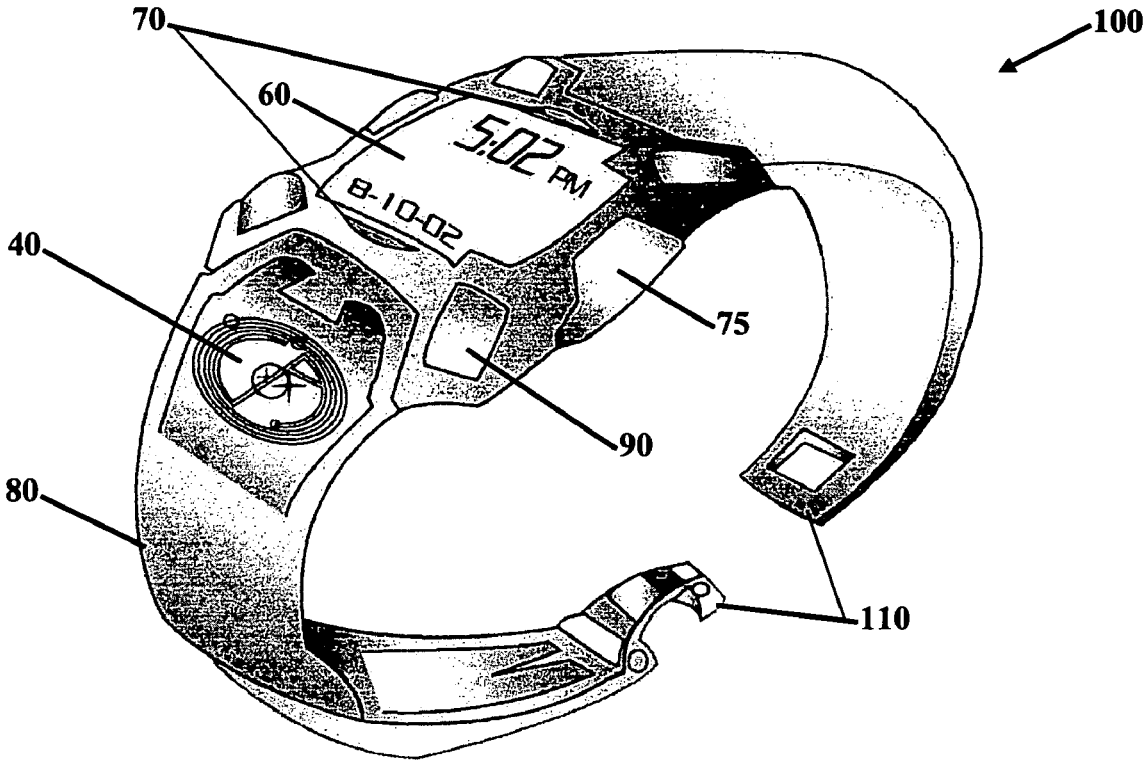
FIG. 5 is an isometric view of a wristwatch style transmitter.

FIG. 4 shows an isometric view of a bracelet style transmitter 100. This style provides some additional benefits over the button styles shown in FIGS. 2 and 3. The advantages of this style include the ability to slip the bracelet over the arm or ankle of a person. Because of the ability to locate the bracelet around a part of the person's anatomy, the bracelet can also be configured with sensors that can monitor the heart rate, blood pressure, temperature and other vital signs of the person wearing the bracelet. If the vital signs of the person exceed a threshold or limit, the transmitter can send a signal indicating the reading from the monitor and signal for help. The bracelet can also be configured with a water or submersion sensor that can signal if the person wearing the bracelet falls into water. A clasp 110 attaches the bracelet to the user. The clasp may require a special key or device to open the bracelet, or if the bracelet is tampered or removed, the bracelet may transmit a warning signal. The panic button 40 can easily be reached and pressed if the person is in trouble or needs assistance. A confirmation light 42 provides feedback to the user that the panic button is active and or activated. A reset button 45 allows the bracelet to be reset and the signal cancelled. It is contemplated that this version of transmitter can be fabricated in a stylish, modern, classical or ornate design as well as an insignia style. The bracelet can also be configured with a tamper and or removal sensor that transmits a signal if the bracelet is removed or tampered with. A special key or tool can be used to remove the bracelet without activating the signal FIG. 5 shows an isometric view of a wristwatch style transmitter 100. This style provides some additional benefits over the button styles shown in FIGS. 2 and 3. The advantages of this style include the ability to wrap or strap the watch over the arm of a person or onto a cane or wheelchair. Because of the ability to locate the watch around a part of the person's anatomy, the watch can also be configured with sensors that can monitor the heart rate, blood pressure, temperature and other vital signs of the person wearing the watch. If the vital signs of the person exceed a threshold or limit, the transmitter can send a signal indicating the reading from the monitor and signal for help. The watch can also be configured with a water or submersion sensor that can signal if the person wearing the watch falls into water. The panic button 40 can easily be reached and pressed if the person is in trouble or needs assistance. It is contemplated that this version of transmitter can be fabricated in a stylish, modern, classical or ornate design as well as an insignia style. The watch can also be configured with a tamper and or removal sensor that transmits a signal if the watch is removed or tampered with. A special key or tool can be used to remove the watch without activating the signal. In this configuration, the watch includes a watchband 80 or wristband, a display 60 that can serve the function of both displaying the time/date as well as providing a display regarding the location, and vital signs that are being monitored. The panic button can be located in a variety of locations on the watch; in the preferred embodiment, the panic button is located on the side of the watch as shown in the figure. Confirmation lights 70 indicate the status of the signal to the receiver. A pager mode reset button 75 resets the signal to the receiver. A clasp 110 attaches the watch to the user. The clasp may require a special key or device to open the watch, or if the watch is tampered or removed, the watch may transmit a warning signal. This configuration also shows a speaker 90 that can be used to communicate with the receiver, parents and or authorities.

If the receiver were the size of a small pager, the receiver would have three range settings, which could be adjusted by a parent or guardian to determine how far a child, adult, pet, or other object would be away from a house or other location. For instance, if the parent or guardian would set the range for 500 feet and the child, person, or other object passes that range. The receiver/pager would beep loud and the child's ID number would flash on the screen, or if the child or person carrying the device hit the panic button, the same reaction on the receiver/pager would be registered. The transmitter is configured in a waterproof enclosure that allows the transmitter to be washed or cleaned without damage. While the enclosure is waterproof, it may still include a submersion sensor that can detect if the transmitter goes under water for a period of time that would not be consistent with one washing their hands.

In use, a user would simply attach a transmitter of the present invention to a child or to an adult and enjoy the knowledge that the exact location of the child or adult could be quickly determined if they are missing or suspected of being a party to foul play. In the event that such a situation would arise, a parent would contact the local authorities, which with the previous recorded transmitter frequency, would activate the transmitter and cause it to send a signal to an overhead satellite network. Satellites would triangulate the received signal, and provide the authorities with the exact location of the signal source, allowing them to quickly go to the child or adult's aid. The panic button feature of the transmitter would allow a wearer to activate the signal if in danger or distress, alerting authorities of their identity and location, again allowing them to contact the parents and respond to the wearer's aid.

The child alert tracking system operates on a support system that utilizes existing and upcoming technology including but not limited to assisted-global position system (A-GPS), cellular and broadband networks.

Thus, specific embodiments of the emergency transmitter and receive apparatus have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A child alert system comprising:

a receiver unit; and a transmitter unit;

the transmitter unit including a battery powered transmitter and a transmitter unit receiver installed within a jewelry item to be worn by a user that is activated remotely by an activation radio signal received by the transmitter unit receiver when the vital signs of the person fall below a certain threshold for allowing a transmitter to send out an emergency signal;

the receiver unit including receiver unit software programmed with the transmitting frequency of the transmitter unit and a receiver unit transmitter for transmitting the activation radio signal;

when activated, the transmitter unit transmitting a signal to an overhead satellite network which responds by triangulating on the received signal and which then transmits a coordinate signal to the receiver unit to instantly provide an operator of the receiver unit with the location of an individual wearing the transmitter unit.

2. The child alert system from claim 1 that further includes activation of the emergency signal by depressing a panic button twice in rapid sequence.

3. The child alert system from claim 1 wherein the receiver unit is adapted for use in a car or other vehicle to allow tracking the signal hands free while on the road.

4. The child alert system from claim 1 wherein the receiver can be locked into the signal from a specific transmitter to locate the location of the transmitter without the transmitter being activated.

5. The child alert system from claim 1 that is further linked to a T.V. satellite, Amber alter or other notification system that can send out a message to an individual or group of individuals notifying them that a problem exists with the person wearing the transmitter.

* * * * *